US007857103B2

(12) United States Patent
Kocher

(10) Patent No.: US 7,857,103 B2
(45) Date of Patent: Dec. 28, 2010

(54) ELEVATOR SYSTEM

(75) Inventor: Hans Kocher, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 131 days.

(21) Appl. No.: 11/956,671

(22) Filed: Dec. 14, 2007

(65) Prior Publication Data

US 2008/0142310 A1 Jun. 19, 2008

Related U.S. Application Data

(60) Provisional application No. 60/870,192, filed on Dec. 15, 2006.

(30) Foreign Application Priority Data

Dec. 14, 2006 (EP) ..... 06126175

(51) Int. Cl.
*B66B 9/00* (2006.01)
*B66B 11/08* (2006.01)
*B66B 11/00* (2006.01)

(52) U.S. Cl. ..... 187/249; 187/258

(58) Field of Classification Search ..... 187/249, 187/256–258, 266; *B66B 11/00, 9/00*
See application file for complete search history.

(56) References Cited

U.S. PATENT DOCUMENTS 1,837,643 A * 12/1931 Anderson ..... 187/249
5,419,414 A * 5/1995 Sakita ..... 187/391
5,526,901 A * 6/1996 Salmon ..... 187/249
5,663,538 A 9/1997 Sakita
5,699,879 A * 12/1997 Sakita ..... 187/249
5,907,136 A * 5/1999 Hongo et al. ..... 187/277
7,296,661 B1 * 11/2007 Petricio Yaksic ..... 187/266
2006/0289240 A1 * 12/2006 Sakita ..... 187/249
2008/0142308 A1 * 6/2008 Kocher ..... 187/249

FOREIGN PATENT DOCUMENTS

EP 1 329 412 A1 7/2003
EP 1 700 809 A 9/2006
JP 03013484 A * 1/1991

* cited by examiner

*Primary Examiner*—Michael R Mansen
*Assistant Examiner*—Stefan Kruer
(74) *Attorney, Agent, or Firm*—Fraser Clemens; Martin & Miller LLC; William J. Clemens

(57) ABSTRACT

An elevator system has a lower elevator car, an upper elevator car and a common counterweight in an elevator shaft. A support device has a first support strand and a second support strand. Each of the elevator cars is connected with the two support strands. In addition, a drive for driving the elevator cars is arranged in the elevator shaft. The drive includes four drive pulleys, wherein a first drive pulley and a second drive pulley are associated with the first support strand and the third drive pulley and the fourth drive pulley are associated with the second support strand.

14 Claims, 4 Drawing Sheets

ELEVATOR SYSTEM

CROSS-REFERENCE TO RELATED APPLICATION

This application claims the benefit of U.S. provisional patent application Ser. No. 60/870,192 filed Dec. 15, 2006.

FIELD OF THE INVENTION

This invention relates to an elevator system having upper and lower elevator cars moving independently in a common elevator shaft.

BACKGROUND OF THE INVENTION

Elevator systems of the kind described above are known, for example, from the patent document EP-1 329 412 A1. The elevator system described therein comprises two elevator cars in a common elevator shaft, each with a respective drive and with only a common counterweight.

It is disadvantageous with this known system, inter alia, that the drive or the traction for the two elevator cars is not uniform. This can have the consequence that, for example, the support means are non-uniformly loaded, which is not desirable.

SUMMARY OF THE INVENTION

It is an object of the present invention to propose an elevator system having upper and lower elevator cars moving independently in a common elevator shaft by which the disadvantages of the state of the art systems are avoided.

According to the present invention, this object is fulfilled by an elevator system with a lower elevator car, an upper elevator car, a common counterweight, a support means for supporting the lower and upper elevator cars, drive means for driving the lower and upper elevator cars, which drive means are arranged in a shaft, and in the common elevator shaft in which the upper elevator car and the lower elevator car vertically move independently of one another. The support means comprises a first support means strand with a first and a second end and a second support means strand with a first and a second end, wherein the drive means comprise four drive pulleys which are so arranged that the first drive pulley and the second drive pulley are associated with the first support means strand and that the third drive pulley and the fourth drive pulley are associated with the second support means strand.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1A:
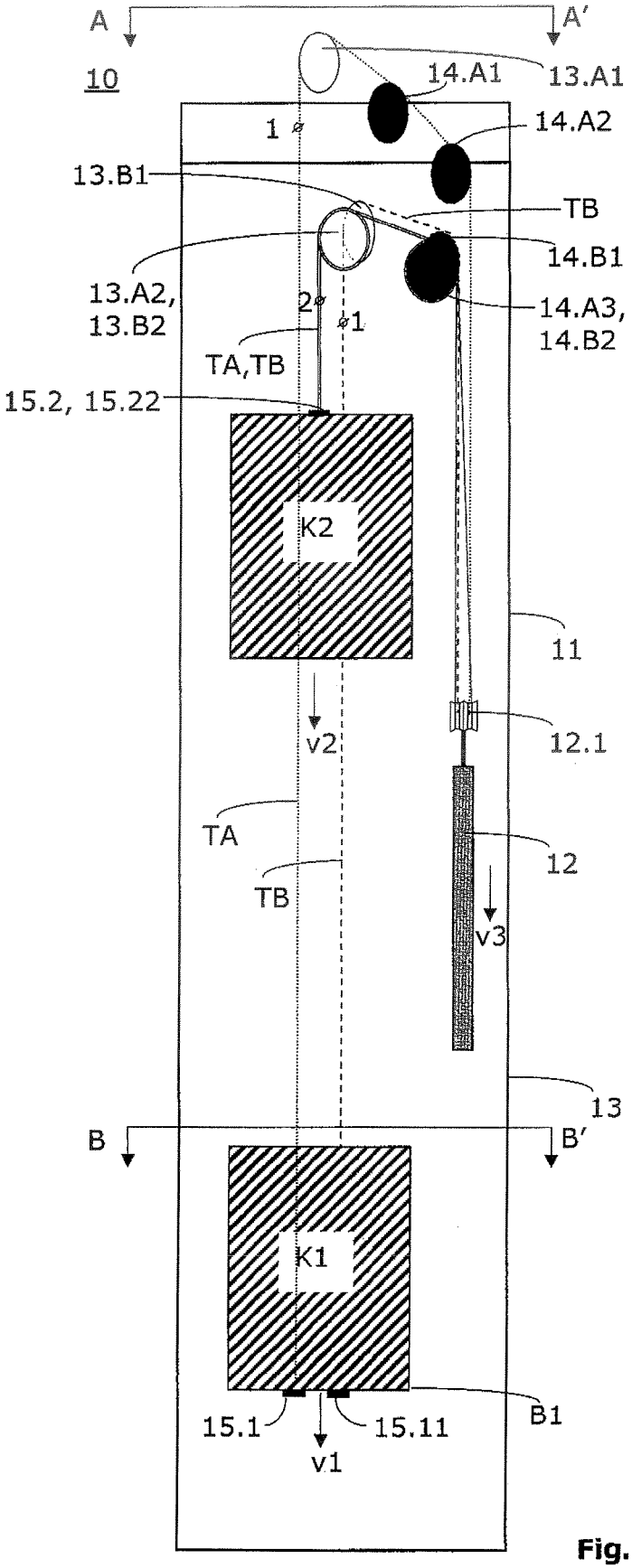
FIG. 1A is a schematic side elevation view of a first embodiment of an elevator system according to the present invention.

The U.S. provisional patent application Ser. No. 60/870,192 filed Dec. 15, 2006 is hereby incorporated herein by reference.

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

The following generally applies to the drawing and the further description:

- The figures are not to be regarded as true to scale.
- The same or similar constructional elements, or constructional elements with the same or similar function, are provided in all figures with the same reference numerals.
- Statements such as right, left, above, below refer to the respective arrangement in the figures.
- Deflecting rollers and deflecting auxiliary rollers are illustrated in sections generally perpendicular to their axes of rotation as black circles.
- Drive pulleys are illustrated generally in sections perpendicular to their axes of rotation as circular lines.
- Those parts or runs of support means strands or tensioning means strands, which are disposed between one of the elevator cars and an upper counterweight deflecting roller, are illustrated by lines different from those parts of the support means strands or tensioning means strands which are disposed between the other elevator car K2 and the upper counterweight deflecting roller.
- It is additionally indicated for each run by a usual diameter signature and with one of the numerals 1 and 2 whether there is concerned at the corresponding locations in each instance one or two support means strands or tensioning means strands; moreover, it is indicated which support means strands or tensioning means strands are concerned.

Figure 1B:
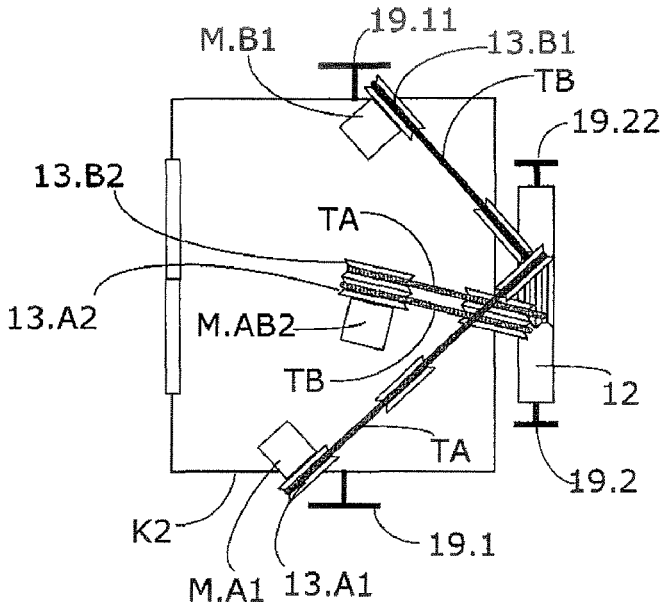
FIG. 1B is a view of the elevator system as seen from line A-A' in FIG. 1A.
Figure 1C:
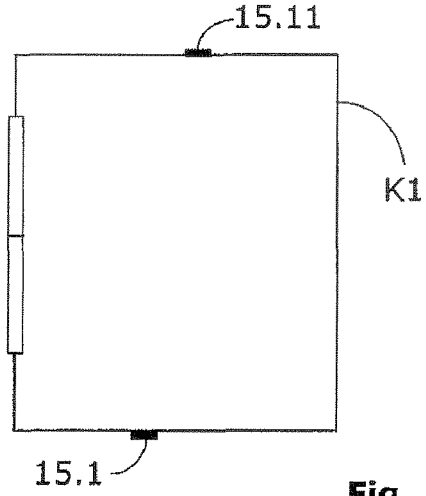
FIG. 1C is a view the elevator system in section along line B-B' in FIG. 1A.

FIGS. 1A, 1B and 1C show a first embodiment of an elevator system 10 according to the present invention. These are schematic views on the basis of which the basic elements of the present invention are explained.

A lower elevator car K1 and an upper elevator car K2 of the new elevator system 10 are disposed one above the other in a common elevator shaft 11. A common counterweight 12 is also disposed in the elevator shaft 11. The counterweight 12 is suspended at an upper counterweight deflecting roller arrangement 12.1 in a so-termed 2:1 suspension. A roller arrangement with more than one roller is also to be understood by the term "counterweight deflecting roller". A speed of the lower elevator car K1 is indicated by "v1", a speed of the upper elevator car K2 by "v2" and a speed of the counterweight 12 by "v3".

Drive means for driving the two elevator cars are disposed in the upper region or above the actual elevator shaft 11. The drive means comprise a first arrangement for the lower elevator car K1 and a second drive arrangement for the upper elevator car K2.

The first drive arrangement, which is associated with the lower elevator car K1, comprises a first motor M.A1 and a second motor M.B1. The motors M.A1 and M.B1 are synchronized (for example electrically or electronically). The first motor M.A1 is coupled with a first drive pulley 13.A1. The second motor M.B1 is coupled with a second drive pulley 13.B1.

The second drive arrangement, which is associated with the upper elevator car K2, comprises a third drive motor M.AB2. The third motor M.AB2 is coupled by way of a common shaft with a third drive pulley 13.A2 and a fourth drive pulley 13.B2, i.e. in this preferred embodiment a common motor M.AB2 for driving two drive pulleys 13.A2 and 13.B2 is provided. However, two separate motors can also be used.

The new elevator system 10 further comprises a flexible support means TA, TB, which consists substantially of a first support means strand TA and a second support means strand TB. The support means strands TA and TB each have a first end and a second end. Advantageously, each of the support means strands TA and TB is formed by two or more parallel support means elements, such as, for example, by two belts or two cables. Each support means strand TA and TB can, however, also comprise only one belt or cable. The load-bearing structure of these support means strands TA and TB is advantageously made of steel, aramide or Vectran (a registered trademark of CNA Holdings, Inc. of Summit, N.J.) material.

In this embodiment, the first drive pulley 13.A1 and the fourth drive pulley 13.B2 are associated with the first support means strand TA, while the second drive pulley 13.B1 and the third drive pulley 13.A.2 are associated with the second support means strand TB.

The motor M.A1 and the drive pulley 13.A1 for the lower elevator car K1 are arranged at a first height. The motor M.B1 and the drive pulley 13.B1, similarly for the lower elevator car K1, are arranged at a second height. The motor M.AB2 and the drive pulleys 13.A2 and 13.B2 for the upper elevator car K2 are similarly arranged at the second height. The second height lies below the first height. This arrangement is advantageous, but not essential.

The elevator system 10 can also comprise four motors, wherein then an individual motor is associated with each drive pulley or each end of the support means strands. However, it is essential for the desired uniform traction that an individual drive pulley is associated with each end of the support means strands in order to thus be able to introduce the drive forces uniformly into the support means strands TA, TB.

Moreover, the new elevator system 10 comprises several deflecting rollers, in the present example a first deflecting roller 14.A1, a second deflecting roller 14.A2 for the first support means strand TA, a third deflecting roller 14.B1 for the second support means strand TB and a fourth deflecting roller 14.A3, 14.B2 for the two support means strands TA and TB.

The lower elevator car K1 has in its lower car region B1 a first fastening region 15.1 and a second fastening region 15.11, which are arranged laterally at mutually opposite sides of the elevator car K1.

The upper elevator car K2 has in its upper car region a third fastening region 15.2 and a fourth fastening region 15.22, which are arranged at least approximately centrally and which in the present example of embodiment virtually coincide at 15.2/15.22. For reasons of clarity of the drawing they are shown in FIG. 1A without horizontal spacing.

The support means strands TA, TB are fixed at the lateral fastening regions 15.1, 15.11 of the lower elevator car K1 and at the central fastening point 15.2/15.22 of the upper elevator car K2 in such a manner that each of the elevator cars K1 and K2 is suspended at both support means strands TA and TB. The elevator cars K1 and K2 are suspended in a so-termed 1:1 suspension at the support means strands TA and TB, as is described in further detail below. The first support means strand TA runs from the first fastening region 15.1 to the lower elevator car K1, where it is fastened by its first end, upwardly and directly to the first drive pulley 13.A1. From the latter, the first support means strand TA runs, for example via the first deflecting roller 14.A1 and the second deflecting roller 14.A2, downwardly to the upper counterweight deflecting roller 12.1. From the latter, the first drive means strand TA runs upwardly, via the deflecting roller 14.A3, further to the third drive pulley 13.A2 and from this directly to the central fastening region 15.2/15.22 at the upper elevator car K2, where it is fastened by its second end.

The second support means strand TB runs upwardly from the second fastening region 15.11 to the lower elevator car K1 and directly to the second drive pulley 13.B1. From the latter, the second support means strand TA runs downwardly via the fourth deflecting roller 14.B1 to the upper counterweight deflecting roller 12.1. From the latter, the second drive means strand TA runs upwardly, via the deflecting roller 14.B2, further to the fourth drive pulley 13.B2 and from this directly to the central fastening point 15.2/15.22 at the upper elevator car K2.

The two support means strands TA and TB respectively run parallel directly to the upper counterweight deflecting roller 12.1 and away from this.

Figure 1D:
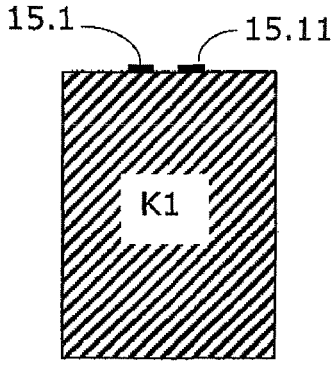
FIG. 1D is a plan view of the lower elevator car illustrated in FIG. 1A, but with fastening regions for the support means strands in the upper car region.

FIG. 1C shows how the introduction of force through the support means strands TA and TB for the elevator car K1 takes place. FIG. 1D shows an alternative with respect thereto.

Figure 2:
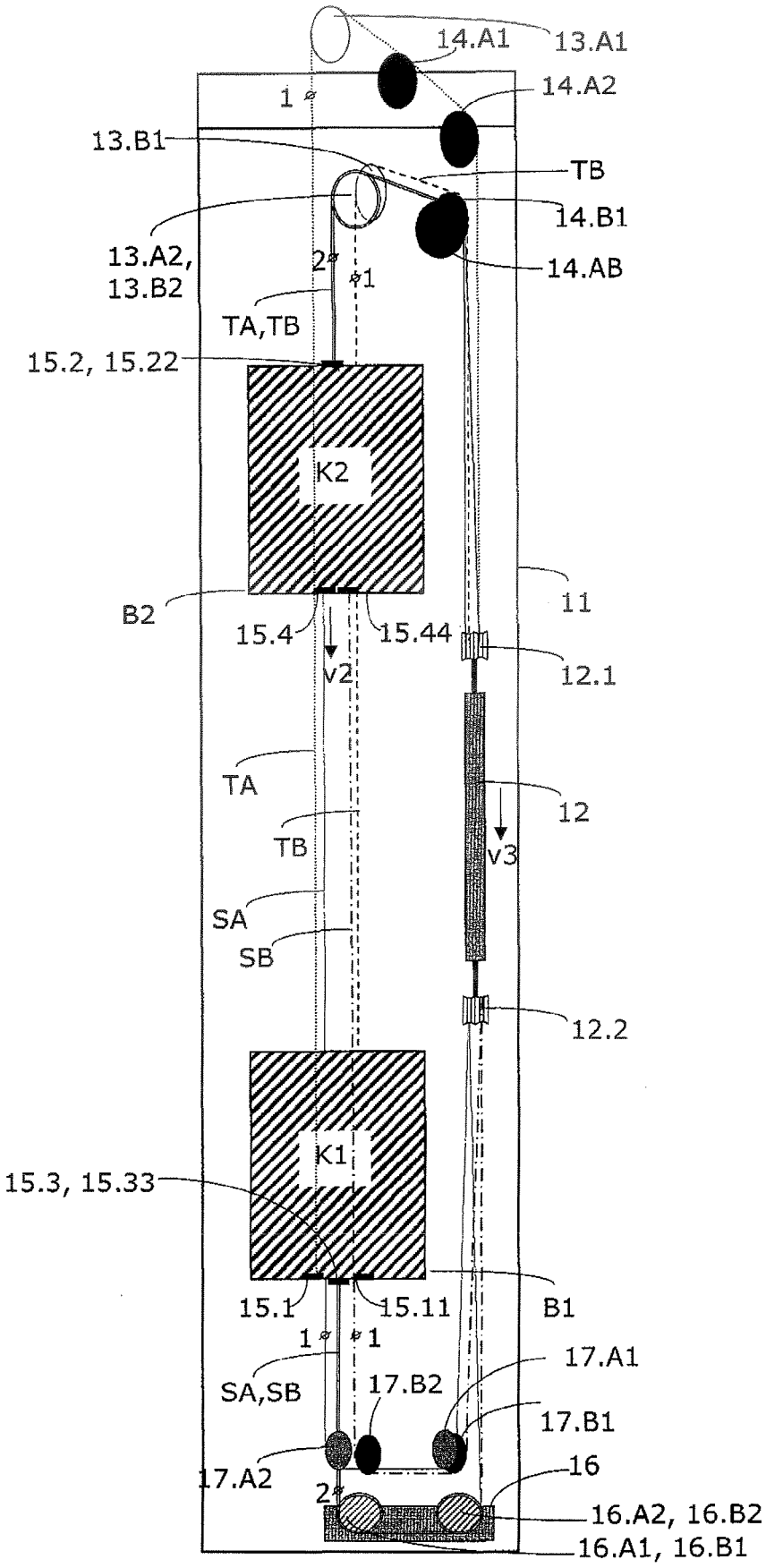
FIG. 2 is a schematic side elevation view of a second embodiment of the elevator system according to the present invention with additional tensioning means.
Figure 3:
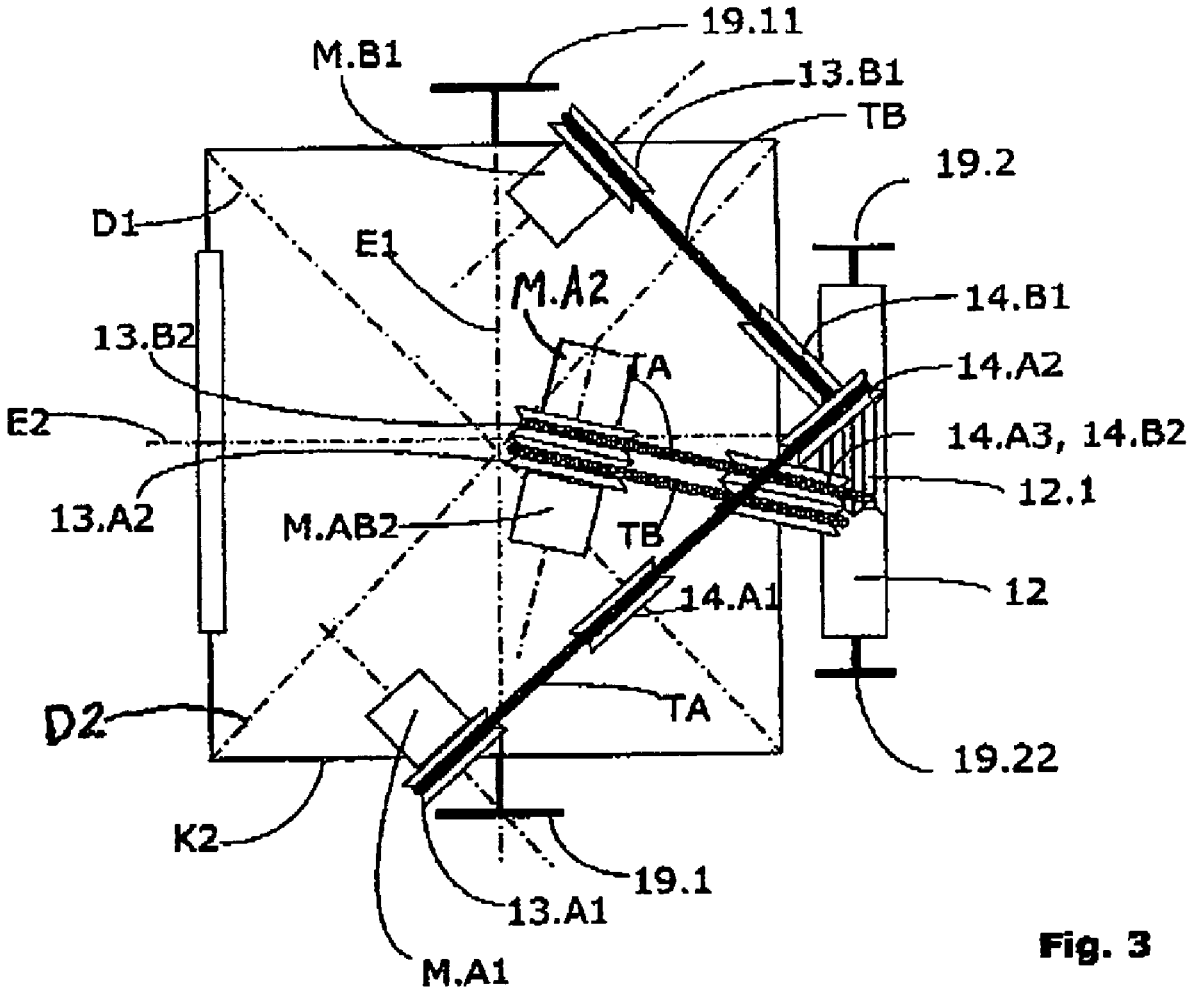
FIG. 3 is an enlarged FIG. 1B showing further details.

FIGS. 1A, 2 and 3 show an advantageous arrangement of the drive pulleys 13.A1, 13.B1, 13.A2, 13.B2 in the uppermost region of the elevator shaft 11. The drive pulleys 13.A1, 13.B1, 13.A2, 13.B2 are arranged vertically, i.e. with horizontal axes, as apparent from FIG. 3. A guide device for the vertical guidance of the cars K1 and K2 in the elevator shaft 11 comprises two stationary guide rails 19.1 and 19.11, which extend vertically along opposite sides of the elevator shaft 11 and are fastened thereto in a manner which is not illustrated. The guide device additionally comprises guide bodies, which are not illustrated. Two guide bodies, which co-operate with the respective guide rails 19.1 and 19.11, are preferably mounted in vertically aligned arrangement on both sides at each of the cars K1 and K2. The guide bodies at a side of the cars K1, K2 are advantageously mounted at the largest possible spacing in height. The guide rails 19.1 and 19.11 are arranged diagonally with respect to the counterweight 12.

A further guide device with two guide rails 19.2, 19.22 is arranged in the region of the narrow sides of the counterweight 12 and serves for guidance of the counterweight 12.

The first support means strand TA, leading from the first fastening point 15.1 at the lower elevator car K1, runs along the same side of the elevator shaft 11 as the guide rail 19.1. The second support means strand TB, leading from the second fastening point 15.11 at the lower elevator car K1, runs along the same side of the elevator shaft 11 as the guide rail 19.11.

FIG. 1C shows the same lower elevator car K1, but with the fastening points 15.1 and 15.11 in the upper car region.

FIG. 2 shows a second embodiment of the elevator system according to the present invention. This comprises all constructional elements described with respect to FIGS. 1A, 1B and 1C as well as an additional device in order to better tighten the support means strands TA and TB and to better guide the elevator cars K1 and K2 as well as the counterweight 12.

The elevator system 10 according to FIG. 2 comprises for this purpose a lower counterweight deflecting roller 12.2 which is suspended at the counterweight 12. Centrally disposed at a lower region B1 of the lower elevator car K1 are a fifth fastening region 15.3 and a sixth fastening region 15.33, which virtually coincide at 15.3/15.33.

A seventh fastening point 15.4 and an eighth fastening point 15.44 are disposed laterally at a lower region B2 of the upper elevator car K2 at opposite sides of the elevator car K2. The seventh fastening point 15.4 and the eighth fastening point 15.44 are, in the present example of embodiment, disposed near those sides of the elevator shaft 11 at which the guide rails 19.1, 19.11 run.

Alternatively, the seventh and eighth fastening points 15.4, 15.44 are disposed in the upper region of the elevator car K2.

A flexible tensioning means SA, SB substantially consists of a first tensioning means strand SA and a second tensioning means strand SB. Each of the tensioning means strands SA and SB has a first end and a second end. Advantageously, each of the tensioning means strands SA, SB is formed by two or more parallel tensioning means elements, such as, for example, by two belts or two cables. Each tensioning means strand SA, SB can, however, also comprise only one belt or cable, The load-bearing structure of the tensioning means strands SA, SB is advantageously made of steel, aramide or Vectran material.

The first and second fastening regions 15.1, 15.11 as well as the fifth and sixth fastening regions 15.3, 15.33 are located in common in the lower region B1 of the car K1 or each on a lower region B1 or upper region of the car K1. If the first and second fastening regions 15.1, 15.11 are located in the upper region of the car K1, the advantage resides in the use of shorter support means strands TA, TB. If the first and second fastening regions 15.1, 15.11 are located in common with the fifth and sixth fastening regions 15.3, 15.33 in the lower region B1 of the car K1 the advantage resides in the simple construction of the car K1. The force-introducing structure then consists substantially of a simple beam.

Analogous arguments also apply to the third, fourth, seventh and eighth fastening regions 15.2, 15.22, 15.4, 15.44, which are located either in common in the upper region of the car K2 or respectively in an upper region or lower region B2 of the car K2. If the seventh and eighth fastening regions 15.4, 15.44 are located in the lower region B2 of the car K2, the advantage resides in the use of shorter tensioning means strands SA, SB. If the seventh and eighth fastening regions 15.4, 15.44 are located in common with the third and fourth fastening regions 15.2, 15.22 in the upper region of the car K2 the advantage resides in the simple construction of the car K1. The force-introducing structure then substantially consists of a simple beam.

Moreover, several deflecting rollers are arranged in the lower region of the elevator shaft 11. Two tensioning rollers 16.A1, 16.A2 for the first tensioning means strand TA and two tensioning rollers 16.B1, 16.B2 for the second tensioning means strand TB are provided. Moreover, two auxiliary rollers 17.A1 and 17.A2 for the first tensioning means strand TA as well as two auxiliary rollers 17.B1, 17.B2 for the second tensioning means strand TB are provided. In addition, a pretensioning arrangement 16 is provided.

The first tensioning means strand SA is fastened by its first end to the central fastening region 15.3/15.33 of the lower elevator car K1 and runs from there around the tensioning rollers 16.A1 and 16.A2 to the lower counterweight deflecting roller 12.2. From the lower counterweight deflecting roller 12.2, the first tensioning means strand SA runs via the deflecting rollers 17.A1 and 17.A2 to the seventh fastening region 15.4 at the upper elevator car K2, where it is fastened by its second end.

The second tensioning means strand SB is fastened by its first end at the central fastening region 15.3/15.33 of the lower elevator car K1 and runs from there around the tensioning rollers 16.B1 and 16.B2 to the lower counterweight deflecting roller 12.2. From the lower counterweight deflecting roller 12.2 the second tensioning means strand SB runs via the deflecting roller 17.B1 and 17.B2 to the eighth fastening region 15.44 at the upper elevator car K2, where it is fastened by its second end.

FIG. 3 is an enlarged illustration of FIG. 1B, in which details are shown which are not apparent or not clearly apparent in FIG. 1C. Illustrated are, in particular, a first vertical center plane E1, a second vertical center plane E2, a first vertical diagonal plane D1 and a second vertical diagonal plane D2.

The first fastening region 15.1 and the second fastening region 15.11 lie in the lower car region on opposite sides of the lower elevator car K1, on opposite sides of the first vertical center plane E1 and on opposite sides of the second vertical center plane E2, in order to ensure a substantially centrally symmetrical, i.e. balanced, force introduction into the elevator car K1 (not shown in FIG. 3). This balanced force introduction has the advantage that less friction and wear occur at the guide rails. Moreover, the occurrence of audible or detectable knocks during travel is significantly reduced.

The fastening region 15.2/15.22 lies centrally at the upper car region of the upper elevator car K1, so that here, too, a central force introduction takes place (not shown in FIG. 3).

FIG. 3 additionally shows that at least three motors M.AB2, M.A1, M.B1 are provided for driving the four drive pulleys 13.A1, 13.A2, 13.B1 13.B2. In an alternative arrangement, the elevator system 10 additionally has a fourth motor M.A2 which drives the drive pulley 13.B2 while the motor M.AB2 drives only the drive pulley 13.A2. Thus, in this alternative arrangement a motor is associated with each drive pulley 13.A1, 13.A2, 13.B1, 13.B2. By comparison with conventional elevator systems in which a motor is associated with each elevator car, up to two motors M.AB2, M.A1, M.B1 are allocated to each car K1, K2 in the illustrated example. Correspondingly, the Individual motor must generate up to half the amount of torque and can thus be designed to be significantly smaller. The advantage of such an arrangement is an extremely flexible and space-saving positioning of the motors in M.AB2, M.A1, M.B1 in the upper region of the elevator shaft 11.

By means of the deflecting rollers 14.A1, 14.A2, 14.A3, 14.B1, 14.B2 the support means strands TA, TB are guided respectively by the drive pulleys 13.A1, 13.A2, 13.B1, 13.B2 above the elevator car K2 to the rear side of the elevator shaft 11 and from there deflected laterally past the elevator cars K1, K2 in the direction of the counterweight 12. These additional deflecting rollers enable use of smaller drive pulleys 13.A1, 13.A2, 13.B1, 13.B2. Small drive pulleys have the advantage that smaller drive torques are needed for operating the elevator system 10. Accordingly, even smaller motors can be used. An even more flexible space-saving positioning of the motors, drive pulleys and deflecting rollers in the upper region of the elevator shaft 11 results therefrom.

Thanks to the small dimensions of the drive pulleys 13.A1, 13.A2, 13.B1, 13.B2 these drive pulleys can, in addition, be arranged at an inclination with respect to the center plane E2. In the illustrated example the drive pulleys 13.A1, 13.B1 are disposed at an inclination relative to one another and enable, in co-operation with the associated deflecting rollers 14.A1, 14.A2, 14.B1, a correspondingly inclined guidance of the support means strands TA, TB above the elevator car K2 towards the projection of the upper counterweight deflecting roller 12.1. The advantage of this guidance running together at an inclination is the use of smaller upper counterweight deflecting rollers 12.1.

Due to the fact that both cars K1, K2 are connected by way of common support means TA, TB with only one counterweight 12 and due to the special form of 1:1 suspension of the cars K1, K2 and the 2:1 suspension of the counterweight 12, different speeds "v1", "v2" and "v3" result depending on the respective travel situation. If the car K1 moves upwardly at the speed "v1" while the car K2 is stationary then the counterweight 12 moves downwardly at v3=v1/2. If the car K2 moves downwardly at the speed "v2" while the car K1 is stationary then the counterweight 12 moves upwardly at v3=v2/2. If the cars K1, K2 move at the same speed v1=v2 towards one another then "v3" is zero. If the car K1 and the car K2 move downwardly at the same speed v1=v2 then the counterweight 12 moves upwardly at v3=v1=v2.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator system comprising a lower elevator car, an upper elevator car, a common counterweight, a support means for supporting the lower and upper elevator cars, a drive means for driving the lower and upper elevator cars with the support means, which drive means are arranged in an elevator shaft for moving the upper elevator car and the lower elevator car vertically independently of one another, further comprising:

a first support means strand of the support means with a first end and a second end;

a second support means strand of the support means with a first end and a second end;

a first drive pulley and a fourth drive pulley of the drive means associated with said first support means strand; and a second drive pulley and a third drive pulley of the drive means associated with said second support means strand, said drive pulleys associated with one of said support means strands rotating in vertical planes being inclined relative to one another, wherein the inclination of one of the vertical planes is about a vertical axis orthogonal to an axis of rotation of one of the drive pulleys.

2. The elevator system according to claim 1 wherein the lower elevator car is suspended in a balanced state at two separate mutually opposite fastening regions, wherein said first end of said first support means strand is fixed to a first one of said fastening regions and wherein a first end of said second support means strand is fixed to a second one of said fastening regions.

3. The elevator system according to claim 2 wherein the upper elevator car is suspended in a common central upper fastening region at said second end of said first support means strand and said second end of said second support means strand.

4. The elevator system according to claim 3 wherein said mutually opposite fastening regions are disposed in a lower car region of the lower elevator car.

5. The elevator system according to claim 3 wherein said mutually opposite fastening regions are disposed in an upper car region of the lower elevator car.

6. The elevator system according to claim 3 wherein said central fastening region is disposed in an upper car region of the upper elevator car.

7. The elevator system according to claim 1 wherein the drive means includes four motors, each of said motors driving an associated one of said first through fourth drive pulleys.

8. The elevator system according to claim 1 wherein the drive means includes a first motor for driving said first drive pulley, a second motor for driving said second drive pulley, and a third motor for driving by a common shaft said third drive pulley and said fourth drive pulley.

9. The elevator system according to claim 1 including tensioning means for exerting downwardly directed tension forces on the lower elevator car and on the upper elevator car and are connected with the counterweight by at least one counterweight deflecting roller.

10. The elevator system according to claim 9 wherein said tensioning means includes a biasing means with two tensioning rollers for a first tensioning means strand and with two other tensioning rollers for a second tensioning means strand.

11. The elevator system according to claim 10 wherein said tensioning means strands are formed from cables or belts.

12. The elevator system according to claim 1 wherein said first and second support means strands are formed from cables or belts.

13. An elevator system comprising a lower elevator car, an upper elevator car, a common counterweight, a support means for supporting the lower and upper elevator cars, a drive means for driving the lower and upper elevator cars with the support means, which drive means are arranged in an elevator shaft for moving the upper elevator car and the lower elevator car vertically independently of one another, further comprising:

a first support means strand of the support means with a first end and a second end;

a second support means strand of the support means with a first end and a second end;

a first drive pulley and a fourth drive pulley of the drive means associated with said first support means strand, said first and fourth drive pulleys rotating in vertical planes being inclined relative to one another, wherein the inclination of one of the vertical planes is about a vertical axis orthogonal to an axis of rotation of one of the first and fourth drive pulleys; and a second drive pulley and a third drive pulley of the drive means associated with said second support means strand, said second and third drive pulleys rotating in vertical planes being inclined relative to one another, wherein the inclination of one of the vertical planes is about a vertical axis orthogonal to an axis of rotation of one of the second and third drive pulleys.

14. An elevator system comprising a lower elevator car, an upper elevator car, a common counterweight, a support means for supporting the lower and upper elevator cars, a drive means for driving the lower and upper elevator cars with the support means, which drive means are arranged in an elevator shaft for moving the upper elevator car and the lower elevator car vertically independently of one another, further comprising:

a first support means strand of the support means with a first end and a second end;

a second support means strand of the support means with a first end and a second end;

a first drive pulley and a fourth drive pulley of the drive means associated with said first support means strand, said first and fourth drive pulleys rotating in vertical planes being inclined relative to one another, wherein the inclination of one of the vertical planes is about a vertical axis orthogonal to an axis of rotation of one of the first and fourth drive pulleys; and a second drive pulley and a third drive pulley of the drive means associated with said second support means strand, said second and third drive pulleys rotating in vertical planes, being inclined relative to one another and said vertical planes associated with said third and fourth drive pulleys extending parallel to one another, wherein the inclination of one of the vertical planes is about a vertical axis orthogonal to an axis of rotation of one of the second and third drive pulleys.

* * * * *